United States Patent [19]

Ebata

[11] Patent Number: 4,583,473

[45] Date of Patent: Apr. 22, 1986

[54] PATTERN CAM SELECTING DEVICE OF A SEWING MACHINE

[75] Inventor: Yoshikazu Ebata, Tokyo, Japan

[73] Assignee: Janome Sewing Machine Co. Ltd., Tokyo, Japan

[21] Appl. No.: 674,020

[22] Filed: Nov. 21, 1984

[30] Foreign Application Priority Data

Nov. 25, 1983 [JP] Japan ..... 58-180921[U]

[51] Int. Cl.[4] ..... D05B 3/02

[52] U.S. Cl. ..... 112/465; 74/54

[58] Field of Search ..... 112/158 A; 74/54, 567

[56] References Cited

U.S. PATENT DOCUMENTS

| | | | |
|---|---|---|---|
| 4,084,523 | 4/1978 | Kasuga | 112/158 A |
| 4,195,583 | 4/1980 | Matsumoto | 112/158 A |
| 4,380,204 | 4/1983 | Hanyu et al. | 112/158 A |
| 4,411,209 | 10/1983 | Szosfak et al. | 112/158 A |

*Primary Examiner*—Werner H. Schroeder
*Assistant Examiner*—Andrew M. Falik
*Attorney, Agent, or Firm*—Michael J. Striker

[57] ABSTRACT

In a pattern cam selecting device of a sewing machine having a plurality of stacked pattern cams, a swingable element is provided, which can be moved in one direction to disengage a cam follower from one of the stacked pattern cams. The cam selecting device further includes a locking element, a clutch mechanism, and actuating mechanism, and a cam rotated upon the rotation of a main shaft of the sewing machine. The swingable element is locked in the follower-disengaging position by the locking element while clutch mechanism is held in an inoperative position by a holding element. The locking element which normally engages the actuating mechanism includes a follower element which is held in a position out of a rotation path of the cam. The locking element releases the actuating mechanism to allow the follower element to come into the rotation path of the cam when the locking element is operated to lock the swingable element while the clutch means is operated in association with the movement of the actuating mechanism to move to an operative position. The clutch mechanism is operated to cause the locking element to unlock the swingable element as the cam starts to rotate and moves the follower element toward the position out of the rotation path of the cam.

7 Claims, 8 Drawing Figures

PATTERN CAM SELECTING DEVICE OF A SEWING MACHINE

BACKGROUND OF THE INVENTION

Field of the Invention

The present invention relates to a pattern selecting device of a sewing machine, and more particularly to a device for enabling a sewing machine operator to select a desired one of the pattern cams in any angular position of a main drive shaft of the sewing machine. More precisely according to the invention, a cam follower may be manually disengaged from one of the pattern cams and engaged to a newly selected pattern cam in any one of the plurality of angular positions of the main drive shaft of the sewing machine, that is, even if a machine needle remains in a fabric to be sewn when the sewing machine is standstill. Further the manually disengaged cam follower may be automatically engaged with the newly selected pattern cam when the sewing machine is driven and the main drive shaft comes to a predetermined angular range in which the machine needle is located above the fabric.

A sewing machine having a conventional pattern cam selecting device generally requires a considerable amount of manual force each time in order to disengage a cam follower from one of the pattern cams in the pattern cam selecting range because the cam follower is normally spring-biased toward the pattern cams. To eliminate such a problem, some sewing machines have been provided with a mechanism for holding the cam follower in a condition in which it is disengaged from the pattern cam when the cam follower is once disengaged until the follower is brought to the engagement with the newly selected pattern cam. The sewing machine may be further provided with a mechanism which is manually and/or automatically (in the initiation of the drive of the sewing machine) operated to release the cam follower so as to engage the newly selected pattern when the follower was brought to the newly selected pattern cam.

However, in such conventional sewing machines, the disadvantage of the cam follower releasing mechanism resides in preventing the pattern cam selecting operation from being performed within a certain angular range of the main drive shaft of the sewing machine. The cam follower releasing mechansim may include an actuating cam rotated in association with the main drive shaft or a lower drive shaft, a follower lever cooperating with the actuating cam to release the cam follower and a toggle spring for pressing the follower lever against the actuating cam until the cam follower is released from the disengaged position, and then for holding the follower lever at a position spaced from the rotation path of the actuating cam when the cam follower has been released. In this case, the follower lever is moved to a stopper with the force of the toggle spring which is amplified with the inertia of the actuating cam which pushes the follower lever. The follower lever will therefore hit the stopper producing a high impact sound and accordingly giving an adverse influence to the endurance of the associated elements.

SUMMARY OF THE INVENTION

The present invention has been devised to eliminate the above mentioned defects and disadvantages of the prior art.

It is a primary object of the invention to provide a pattern cam selecting device of a sewing machine, which is simple in structure and smooth in operation.

It is another object of the invention to enable a sewing machine operator to select a desired one of pattern cams manually and automatically regardless the angular positions of the main drive shaft of the sewing machine.

It is still another object of the invention to produce the products easily and at lower cost.

The objects of the invention are attained by a pattern selecting device of a sewing machine, which substantially comprises a swingable element which is swingable between a first position in which this element operaties to engage a cam follower to one of stacked pattern cams and a second position in which the swingable element disengages the cam follower from the pattern cam; a mechanism for locking the swingable element in the second position; a clutch mechanism movable between an inoperative position in which the clutch mechanism allows the locking mechanism to lock the swingable element and an operative position in which the clutch mechanism is ready to cause the locking mechanism to unlock the swingable element; a holding mechanism for holding the clutch mechanism in the inoperative position when the swingable element is moved to the second position; a cam rotated in association woth the rotation of a main drive shaft of the sewing machine; and an actuating mechanism including a follower element, the actuating mechanism being normally held in an inoperative position by the locking mechanism, in which position the follower element is located out of the rotation path of the cam, the actuating mechanism being released by the locking mechanism into an operative position as the locking mechansim moves to lock the swingable element in the second position, while the follower element is allowed to come into the rotation path of the cam. The clutch mechanism is operated in association with the movement of the actuating mechanism to move to the operative position thereof, the follower element cooperating with the cam as the latter starts to rotate to thereby move the actuating mechanism to the inoperative position. The actuating mechansim in turn operates the clutch mechanism so as to cause the locking mechanism to unlock the swingable element, then the locking mechanism holding the actuating mechanism in said inoperative position.

The other features and advantages of the invention will be apparent from the following description of a preferred embodiment in reference to the attached drawings.

DETAILED DESCRIPTION OF THE PREFERRED EMBODIMENTS

Figure 1:
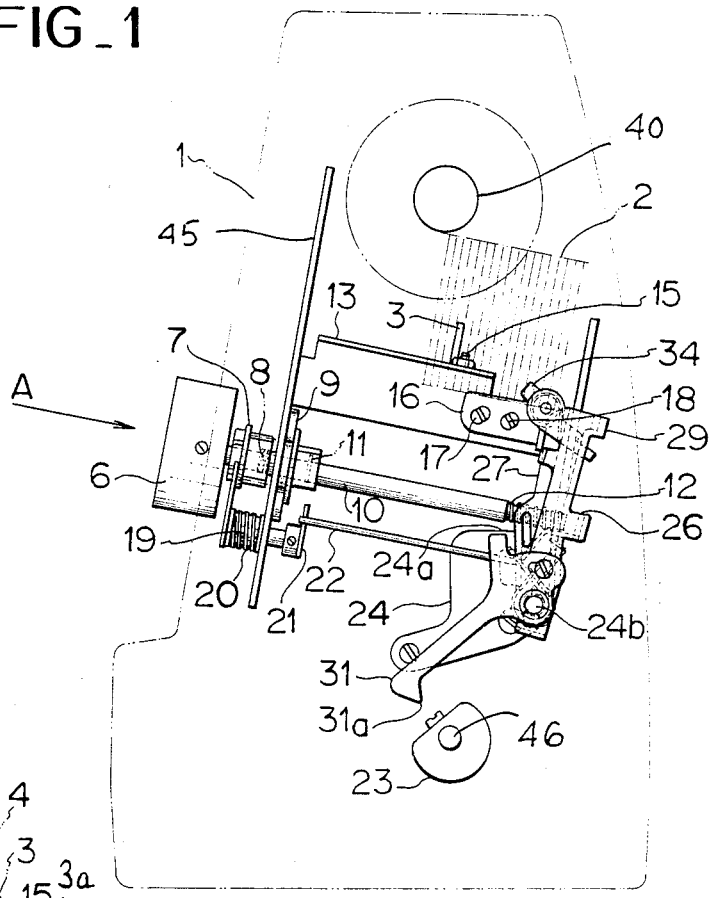
FIG. 1 is a front elevation view of a device according to the invention.
Figure 2:
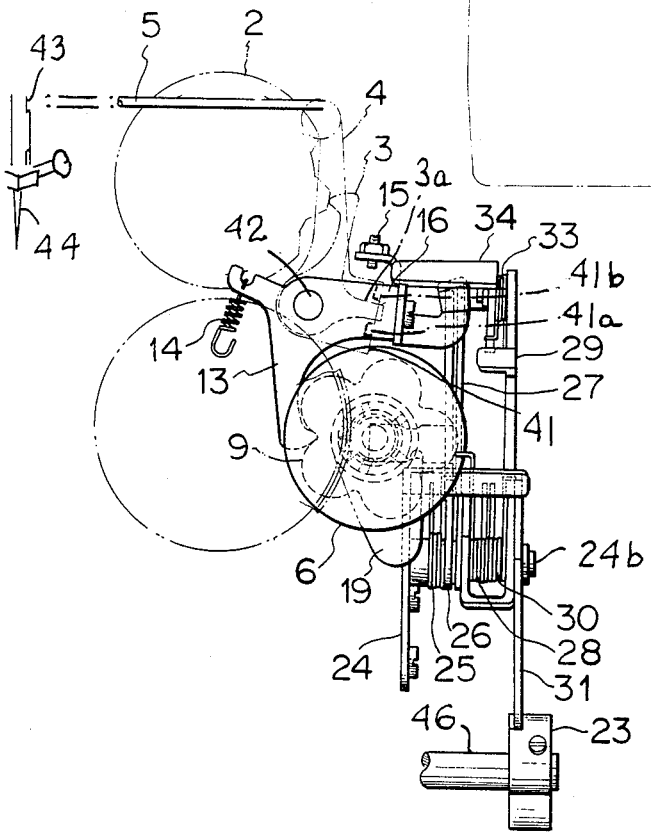
FIG. 2 is a view of the device taken from arrow A in FIG. 1.
Figure 3:
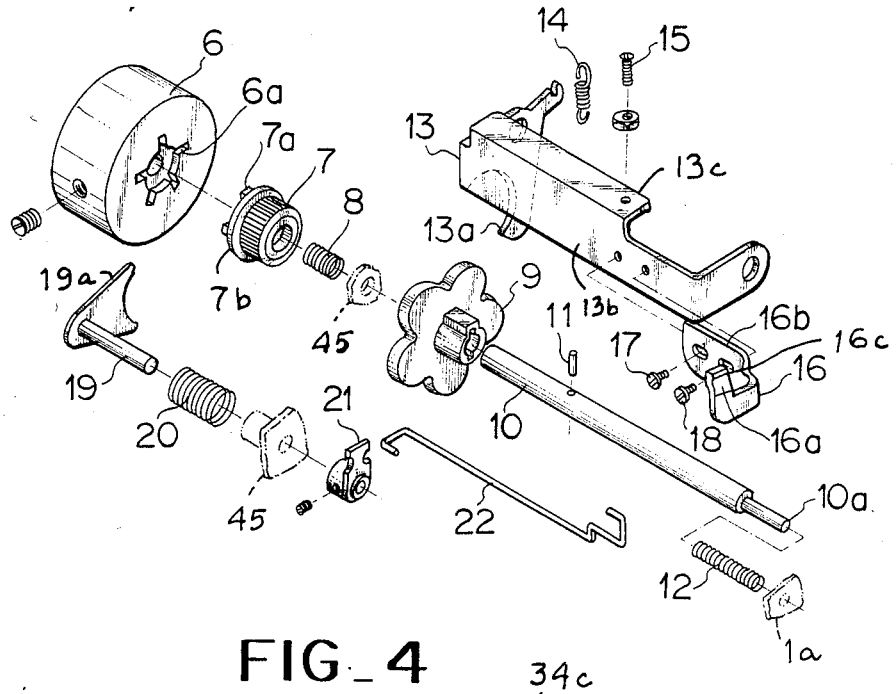
FIG. 3 is an exploded perspective view of the device, with parts removed to show the specific elements of the device.

With reference to FIGS. 1 to 3 it will be seen that a housing 1 of a sewing machine has stacked pattern cams 2 arranged therein, which cams may be rotated at a reduced speed in association with the rotation of a main drive shaft 40. A cam follower 3 having a projection 3*a* is turnably mounted on a transverse guide shaft 42 which is extended in parallel with the stacked pattern cams 2. A U-shaped frame 41 is swingably mounted on the guide shaft 42. The frame 41 has a vertical wall 41*a* extended in parallel with the guide shaft 42. The wall 41*a* has a transverse groove 41*b*, which is extended in parallel with the guide shaft 42, and the projection 3*a* of the cam follower 3 engages in the groove 41*b*. The frame 41 is normally spring-biased in the counterclockwise direction in FIG. 2 to press the cam follower 3 against one of the stacked pattern cams. The frame 41 is formed with an upwardly extended arm 4 which is operatively connected by a transmission rod 5 to a needle bar 43 having a needle 44 attached to the lower end thereof.

Further another U-shaped frame 13 is swingably mounted on the guide shaft 42 and is normally biased by a spring 14 in the counterclockwise direction in FIG. 2. The frame 13 has a downwardly extended follower pawl 13*a* and a wall 13*b* (FIG. 3) extended in parallel with the veritcal wall 41*a* of the frame 41 on the outside of the latter. The wall 13*b* is partly bent at one end thereof to provide a horizontally extended wall 13*c* overhanging the swingable frame 41. The overhanging wall 13*c* has a screw 15 secured thereto. The frame 13 has an auxiliary member 16 secured thereto by screws 17, 18. The member 16 has an inclined cam face 16*a* terminated with an upper end 16*c* and an upper cam face 16*b*.

As shown in FIG. 1, a control shaft 10 is extended through a bracket 45 in parallel with the guide shaft 42 and is rotatable. The control shaft 10 has one end protruded out of the machine housing on the front thereof. A dial 6 is secured to the protruded end of the control shaft 10. A pattern selecting cam 9 is secured to the control shaft 10 by a pin 11 on one side of the bracket 45, and a pattern selecting gear 7 is secured to the control shaft 10 between the bracket 45 and the dial 6. The pattern sleecting gear 7 has a flange 7*b* (FIG. 3) formed with projections 7*a* on one face thereof opposite to the inner face of the dial 6 which is formed with a recess 6*a*. The gear 7 is normally biased toward the dial 6 by a spring 8 arranged between the gear 7 and the bracket 45. The control shaft 10 has a diametrically reduced free end portion 10*a* which is supported by a part 1*a* of the machine housing 1. A compression spring 12 is mounted on the reduced free end portion 10*a* between the shaft 10 and the part 1*a* of the machine housing 1 and normally biases the control shaft to the left in FIGS. 1 and 2 until the pattern selecting cam 9 is pressed against the bracket 45.

A shorter shaft 19 is extended through the bracket 45 and has a plate 19*a* secured to one end thereof and an anchor element 21 secured to the other end thereof. The plate 19*a* is partly located between the dial 6 and the pattern selecting gear 7. A compression spring 20 is mounted on the shaft 19 between the plate 19*a* and the bracket 45 and normally biases the plate toward the dial 6. A rod 22 is provided which has one end connected to the anchor element 21 and the other end connected to a locking member 26 which will be described below.

Figure 4:
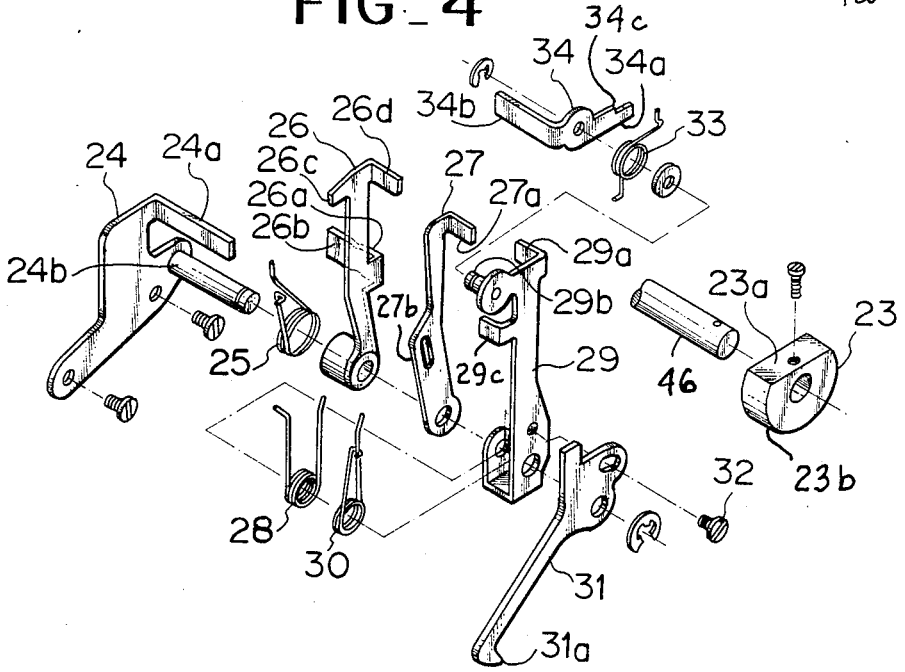
FIG. 4 is an exploded perspective view of the device, showing substantial elements of the invention.

Further in reference to FIG. 4, a bracket 24 is fixedly arranged in the machine housing 1. The bracket 24 is provided with a stopper arm 24*a* and a pivot shaft 24*b* which are extended transversely of the control shaft 10. The locking member 26 in the form of an elongated plate is at the lower end thereof turnably mounted on the shaft 24*b* of the bracket 24 and is normally biased in the counterclockwise direction by a spring 25. The locking member 26 has a first arm 26*c* and a laterally extended second arm 26*d* formed at the top thereof, and has a laterally extended abutment 26*a* providing a face 26*b*. The aforementioned rod 22 has the other end connected to the abutment 26*a* of the locking member 26. A holding member 27 in the form of an elongated plate is at the lower end thereof turnably mounted on the shaft 24*b* and is normally biased in the counterclockwise direction by a spring 28 until the front edge 27*b* thereof is pressed against extended arm 27*a* formed at the top thereof. An actuating member 29 in the form of an elongated plate is at the lower end thereof turnably mounted on the shaft 24*b* and is normally biased in the counterclockwise direction by a spring 30. The actuating member 29 has a laterally extended abutment 29*a* and a laterally extended pin 29*b* provided at the top thereof and has a laterally extended arm 29*c*. A clutch member 34 in the form of a lever providing a first arm 34*a* and a second arm 34*b* is at the intermediate thereof turnably mounted on the pin 29*a* of the actuating member 29 and is normally biased in the counterclockwise direction by a coil spring 33 having one end hung to the first arm 34*a* of the clutch member 34 and the other end anchored to the laterally extended arm 29*c* of the actuating member 29. The first arm 34*a* is formed with a stepped portion 34*c*. A follower member 31 having a lower follower tip 31*a* is at the upper part thereof turnably mounted on the shaft 24*b* and is connected to the actuating member 29 by a screw 32, so that the both members may be made integral and operated as an actuating mechanism. A cam 23 having a circumferential portion 23*b* and a cutout portion 23*a* is secured to a lower drive shaft 46 which is rotated in association with the main drive shaft 40 of the sewing machine.

With reference to FIGS. 2 through 5 it will be seen that when the pattern cam selecting operation is finished, the follower pawl 13*a* of the swingable frame 13 engages the diametrically reduced part of the pattern selecting cam 9 and the lower end of the screw 15 of the swingable frame 13 is located above the swingable frame 41. The frame 41, which is normally spring-biased in the counterclockwise direction in FIG. 2, is free to engage the cam follower 3 to a selected one of the stacked pattern cams 2.

Figure 5:
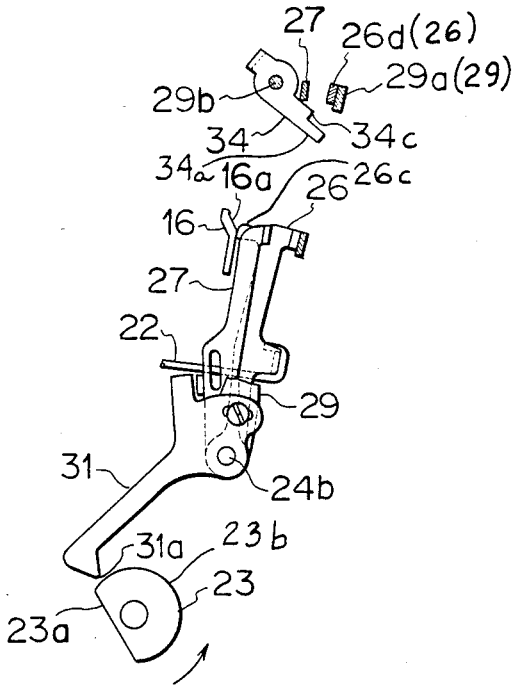
FIGS. 5 through 8 are views of the device showing various operational positions of the device.

In this condition, the second arm 34*b* of the clutch member 34 engages the upper cam face 16*b* of the auxiliary member 16 secured to the swingable frame 13, and the arm 27*a* of the holding member 27 engages the first arm 34*a* of the clutch member 34, and the first arm 26*c* of the locking member 26 engages the lower end of the inclined cam face 16*a* of the auxiliary member 16 while the second arm 26*d* of the locking member 26 engages the abutment 29*a* of the actuating member 29 to hold the follower tip 31*a* of the follower member 31 at a position out of the rotation path of the cam 23, as shown in FIG. 5.

In this condition, the plate 19*a* (FIG. 3) is pulled to the right against the force of the compression spring 20 by the rod 22 having the right end connected to the abutment 26*b* of the locking member 26, and therefore the cam selecting gear 7 is pulled out of the engagement with the recess 6*a* of the dial 6.

When the dial 6 is rotated to select a new pattern cam, the larger diameter portion of the pattern selecting cam 9 engages the follower pawl 13*a* of the swingable frame 13 and swingingly moves the frame 13 around the guide shaft 42 in the clockwise direction in FIG. 2 against the action of the spring 14. Then the lower end of the screw 15 of the frame 13 engages the frame 41 to turn the latter around the guide shaft 42 in the clockwise direction to thereby disengage the cam follower 3 from the precededly selected pattern cam. As the result, the auxiliary member 16 is moved downwardly and allows the clutch member 34 and the locking member 26 to turn in the counterclockwise direction.

Figure 7:
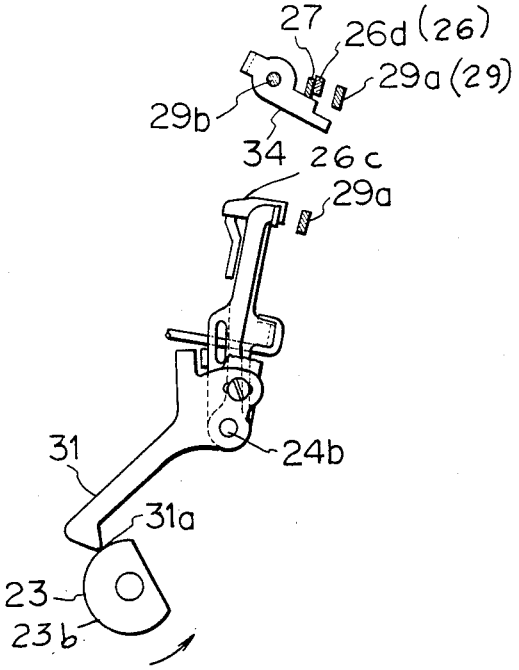

Provided that the dial 6 is rotated to select a new pattern cam when the circumferential portion 23*b* of the cam 23 happens to be opposite to the follower tip 31*a* of the follower member 31, as shown in FIG. 5, the actuating mechanism (29, 31) is prevented from turning in the counterclockwise direction around the pivot shaft 24*b* of the bracket 24 even if the locking member 26 turns in the counterclockwise direction and releases the actuating member 29 as shown in FIG. 7. Therefore the actuating mechanism (29, 31) is held at the initial position as shown. In this case, the clutch member 34 is held in the initial position by the holding member 27 so that the stepped portion 34*c* of the clutch member will not be in the way of the locking member 26 which is allowed to turn to lock the swingable frame 13 in the cam follower disengaging position.

With reference to FIGS. 3 to 5, it is seen that the locking member 26 is therefore, turned counterclockwise, and the first arm 26*c* slides along the inclined cam face 16*a* of the auxiliary member 16 as the latter swings down and engages the top 16*c* of the inclined cam face 16*a* to thereby lock the swingable frame 13 in the cam follower disengaging position. Simultaneously the locking member 26 allows the plate 19*a* to move toward the dial 6 due to the action of the compression spring 20, and accordingly the pattern selecting gear 7 is moved to the dial 6 due to the action of the spring 8 and is connected to the dial 6.

Therefore as the dial 6 is rotated continuously, the disengaged cam follower 3 is moved along the guide shaft 42 and along the stacked pattern cams 2 through a conventional transmission mechanism (not shown). The description of this mechanism is omitted herein because substantially the same mechanism may be referred to in U.S. Pat. No. 4,084,523 of the same applicant.

When the cam follower 3 comes opposite a selected pattern cam, the dial 6 is pushed against the action of the spring 12. Then the end 10*a* of the control shaft 10 is pressed against the face 26*b* of the abutment 26*a* of the locking member 26 and turns the latter in the clockwise direction. Thus the swingable frame 13 is unlocked and released. Then the swingable frame 13 swings back due to the action of the spring 14, and accordingly the frame 41 is allowed to swing back and the cam follower 3 engages the selected pattern cam, and the related members take the positions again as shown in FIG. 5. Thus the swingable frame 13 may be manually unlocked from the locked position.

Figure 6:
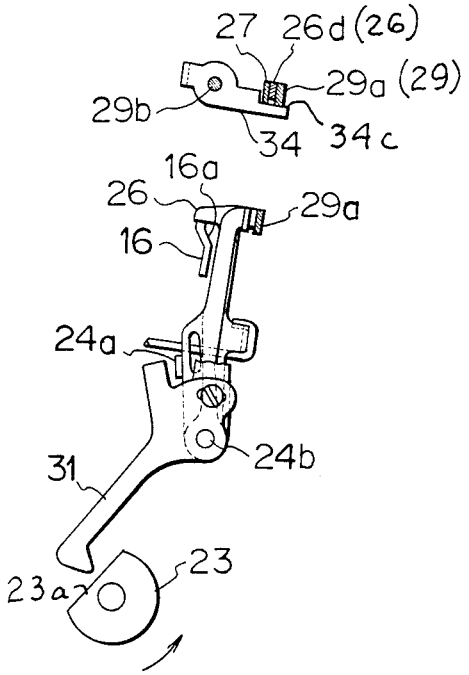

Now in reference to FIGS. 3, 4 and 6, provided that the dial 6 is rotated for a pattern cam selection when the cutout portion 23*a* of the cam 23 is opposite to the follower tip 31*a* of the follower member 31, the locking member 26 moves to lock the swingable frame 13 in the cam follower disengaging position, and subsequently the actuating mechanism (29, 31) is turned in the counterclockwise direction. In this case, the clutch member 34 is moved with respect to the holding member 27 and also may be turned counterclockwise around the pin 29*b*. Thus the clutch member takes the position ready to disengage the locking member 26 from the top 16*c* of the inclined cam face 16*a* when the actuating member (29, 31) is turned in the clockwise direction. Even in this case, the swingable frame 13 may be unlocked by manually pushing the dial 6.

The swingable frame 13 may be unlocked automatically without pushing the dial 6 when the sewing machine starts to be driven. In reference to FIGS. 4 and 5, when the dial 6 is rotated to select a new pattern cam, the swingable frame 13 is turned around the guide shaft 42 (FIG. 2) in the clockwise direction to thereby disengage the cam follower 3 from the precededly selected pattern cam in the way as described above. The auxiliary member 16 is moved together with the swingable frame 13. As the result, the locking member 26 turns counterclockwise and the first arm 26*c* slides along the inclined cam face 16*a* and engages the top 16*c* of the cam face 16*a* to thereby lock the swingable frame 13 in the cam follower disengaging position. In the meantime the actuating mechanism (29, 31) remains in the initial position as shown because the circumferential portion 23*b* of the cam 23 is positioned opposite to the follower tip 31*a* of the follower member 31. In the meantime the clutch member 34 on the actuating member 29 is held in the initial position, as shown, by the holding member 27 against the force of the spring 33 so that the first arm 34*a* may not be in the way of the locking member 26 moving to lock the swingable frame 13.

Now in reference to FIGS. 4 and 6, when the sewing machine is driven and the cam 23 is rotated in the direction indicated by the arrow mark and the cutout portion 23*a* of the cam 23 is positioned opposite to the follower tip 31*a* of the follower member 31, the actuating mechanism (29, 31) is turned counterclockwise around the pivot shaft 24*b* due to the action of the spring 30. In the meantime the clutch member 34 moves to the left with respect to the holding member 27, and also turns counterclockwise around the pin 29*b* by the action of the spring 33. After all, the actuating mechanism (29, 31) turns counterclockwise until the abutment 29*a* of the actuating member 29 is pressed against the second arm 26*d* of the locking member 26. On the other hand, the clutch member 34 turns counterclockwise until the stepped portion 34*c* of the clutch member 34 is pressed against the arm 27*a* of the holding member 27 and/or the abutment 29*a* of the actuating member 29.

In reference to FIGS. 4 and 7, as the cam 23 is further rotated and the circumferential portion 23*b* of the cam 23 comes again opposite to the follower tip 31*a* of the follower member 31, the actuating mechanism 29, 31 is turned clockwise around the pivot shaft 24*b* against the action of the spring 30. The clutch 34 is moved to the right with respect to the holding member 27 and the locking member 26 while the clutch member 34 is turned clockwise around the pin 29*b* against the action of the spring 33. In the meantime the clutch member 34 moves the locking member 26 to the right through the holding member 27 to thereby disengage the first arm 26*c* of the locking member 26 from the top 16*c* of the inclined cam face 16*a*, and the swingable frame 13 is going to swing back due to the action of the spring 14 (FIG. 2).

Figure 8:
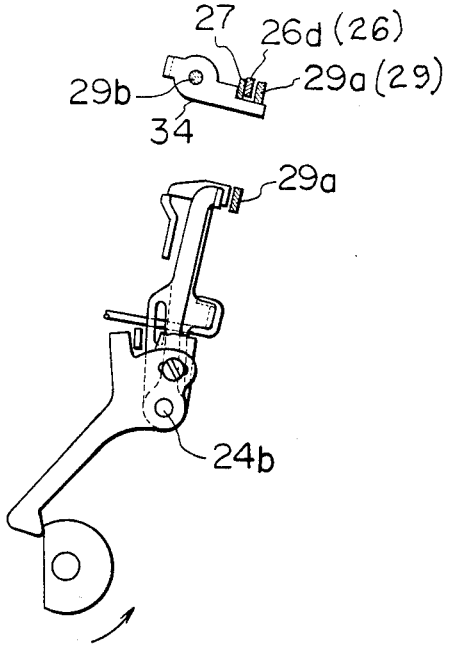

In reference to FIGS. 4 and 8, as the cam 23 is continuously rotated and the cutout portion 23*a* is positioned again opposite to the follower tip 31*a* of the follower member 31, the actuating mechanism (29, 31) turns counterclockwise again and releases the locking member 26. Then the first arm 26*c* of the locking member 26 engages the inclined cam face 16*a* as the cam face 16*a* goes up together with the swingable frame 13. In the meantime the clutch member 34 moves to the left with respect to the holding member 27 and the locking member 26 while the clutch member is turned counterclockwise around the pin 29*b* due to the action of the spring 33 until the stepped portion 34*c* of the clutch member 34 is pressed against the arm 27*a* of the holding member 27 and/or the abutment 29*a* of the actuating member 29.

Finally in reference to FIG. 5, as the cam 23 is continuously rotated and the circumferential portion 23*b* is positioned, again opposite to the follower tip 31*a* of the follower member 31, the actuating mechanism (29, 31) is turned again in the counterclockwise direction and the first arm 26*c* of the locking member 26 engages the lower end of the inclined cam face 16*a* while the second arm 26*d* of the locking member 26 engage the abutment 29*a* of the actuating member 29 to thereby hold the follower tip 31*a* of the follower member 31 out of the rotation path of the cam 23. In the meantime the clutch member 34 moves to the right with respect to the holding member 27 and the locking member 26 while the clutch member is turned clockwise due to the engagement between the first arm 34*a* of the clutch member and the arm 27*a* of the holding member 26. Simultaneously, the upper cam face 34*b* of the clutch member engages the second arm 34*b* of the clutch member 34. Thus the swingable frame 13 is unlocked or released from the locking member 26 and returns to the initial position due to the action of the spring 14, and the cam follower 3 is accordingly released and engages the newly selected pattern cam.

In this condition, the locking member 26 pulls the rod 22 to the right in FIG. 3 against the action of the compression spring 20 and accordingly the shaft 19 is moved in the same direction, and as the result, the plate 19*a* disconnects the portern selecting gear 7 from the dial 6.

It will be understood that each of the elements described above, or two or more together, may also find a useful application in other types of pattern cam selecting devices differing from the types described above.

While the invention has been illustrated and described as embodied in a pattern cam selecting device, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

What is claimed is:

1. A pattern cam selecting device of a sewing machine having needle penetrating a fabric to be sewn to form stitches thereon, stacked pattern cams rotated upon the rotation of the main drive shaft, a cam follower normally spring-biased toward the pattern cams to engage a selected one of the pattern cams, the cam follower being operated to move along the stacked pattern cams to select a desired pattern cam, the pattern cam selecting device comprising;

(a) swingable means (13) swingable between a first position in which said cam follower is released to engage one of said stacked pattern cams and a second position in which said cam follower is disengaged from said pattern cam;

(b) manually operated means for swinging said swingable means;

(c) locking means (26) operated to lock said swingable means in said second position;

(d) cam means (23) rotated by and upon the rotation of said main drive shaft and having a predetermined cam range of a larger diameter and a predetermined cam range of a smaller diameter;

(e) actuating means (29, 31) including a lever (29) turnable about an intermediate shaft and having a follower element (31) provided at one end of said lever, said lever being normally spring-biased in one direction such that said follower element may come into a rotation path of said cam means (23), said follower element being held out of the rotation path of said cam means by said locking means (26) when said swingable means is in said first position;

(f) clutch means (34) operatively connected with said actuating means and operated to move between an inoperative position and an operative position in which said clutch means is ready to unlock said locking means from said swingable means; and (g) clutch holding means (27) for holding said clutch means in said inoperative position to allow said locking means to move to lock said swingable means in said second position, wherein said lever is released and said follower element comes into the rotation path of said cam means when said smaller diameter cam range of said cam means comes opposite to said follower element while said clutch means is moved from said inoperative position to said operative position, said clutch means being moved from said operative position to said inoperative position to cause said locking means to unlock said swingable means when said follower element engages said larger diameter cam range of said cam means during a subsequent rotation of the latter.

2. The pattern cam selecting device as defined in claim 1, wherein said swingable means includes a substantially U-shaped frome provided with a follower pawl (13*a*), a first cam (16*c*) and second cam (168), and is normally spring-biased to said first position, and wherein said manually operated means includes a dial and a cam cooperating with said follower pawl to swing said U-shaped frame from said first position to said second position.

3. The pattern cam selecting device as defined in claim 2, and wherein said locking means, said actuating means and said clutch holding means include a first, a second and a third elongated members (26, 29, 27), respectively, said elongated members being turnably mounted on a common axis and spring-biased in one direction, and wherein said clutch means includes a lever element (34) turnably mounted on said second elongated member and spring-biased in one direction, said lever element having a first arm (34*b*) and a second arm (34*a*), said first arm (34*b*) engaging said first cam of said U-shaped frame in said inoperative position when said U-shaped frame is in said first position.

4. The pattern cam selecting device as defined in claim 2, wherein said third elongated member (27) has an arm (27*a*) engaging said second arm (34*a*) of said lever element (34) to hold the latter in said inoperative position when said U-shaped frame is in said second position.

5. The pattern cam selecting device as defined in claim 2, wherein said second elongated member (29) has an abutment (29*a*), and said first elongated member (26) has a first arm (26*c*) for cooperating with said first and second cams of said U-shaped frame to lock the latter in said second position, said first elongated member (26) having a second arm (26*d*) for engaging said abutment (29*a*) of said second elongated member to hold said follower element in a position out of the rotation path of said cam means (23) while said first arm (26*c*) engages said second cam of said U-shaped frame when the latter is in said first position.

6. The pattern cam selecting device as defined in claim 1, wherein the machine needle is located above the fabric when said clutch means is moved from said operative position to said inoperative position to cause said locking means to unlock said swingable means while said follower element engages said larger diameter cam range of said cam means.

7. A pattern cam selecting device of a sewing machine having a main drive shaft rotated to vertically reciprocate a machine needle to penetrate a fabric to be sewn to form stitches thereon, stacked pattern cams rotated upon the rotation of the main drive shaft, a cam follower normally spring-biased toward the pattern cams to engage a selected one of the cam patterns, the cam follower being operated to move along the stacked pattern cams to select a desired pattern cam, the pattern cam selecting device comprising;

(a) swingable means (13) swingable between a first position in which said cam follower is released to engage one of said stacked pattern cams and a second position in which said cam follower is disengaged from said pattern cam;

(b) locking means (26) operated to lock said swingable means in said second position;

(c) cam means (23) rotated upon the rotation of said main drive shaft and having a predetermined cam range of larger diameter and a predetermined cam range of smaller diameter;

(d) actuating means (29, 31) including a lever turnable about an intermediate shaft having a follower element (31) provided at one end thereof, said lever being normally spring-biased in one direction such that said follower element may come into a rotation path of said cam means (23), said follower element being held out of the rotation path of said cam means by said locking means (26) when said swingable means is in said first position;

(e) clutch means (34) operatively connected with said actuating means to move between an inoperative position and an operative position in which said clutch means is ready to unlock said locking means from said swingable means;

(f) clutch holding means (27) for holding said clutch means in said inoperative position to allow said locking means to move to lock said swingable means in said second position, wherein said lever is released and said follower element comes into the rotation path of said cam means when said smaller diameter cam range of said cam means comes opposite to said follower element while said clutch means is moved from said inoperative position to said operative position, said clutch means being moved from said operative position to said inoperative position to cause said locking means to unlock said swingable means when said follower element engages said larger diameter cam range of said cam means during a subsequent rotation of the latter; and (g) manually operated means including a manually operated dial (6) and a control shaft (10) movable by an operation of said dial, said manually operated means being operated in one way to select one of said pattern cams and in another way to cause said locking means to unlock said swingable means to thereby release the latter from said second position.

* * * * *